US007332842B2

(12) United States Patent
Kasahara et al.

(10) Patent No.: US 7,332,842 B2
(45) Date of Patent: Feb. 19, 2008

(54) FAN MOTOR

(75) Inventors: Takashi Kasahara, Fukushima (JP); Masaaki Takagi, Saitama (JP)

(73) Assignee: Nidec Copal Corporation, Tokyo (JP)

( * ) Notice: Subject to any disclaimer, the term of this patent is extended or adjusted under 35 U.S.C. 154(b) by 492 days.

(21) Appl. No.: 10/936,690

(22) Filed: Sep. 9, 2004

(65) Prior Publication Data

US 2005/0058559 A1 Mar. 17, 2005

(30) Foreign Application Priority Data

Sep. 11, 2003 (JP) ..... P.2003-319763

(51) Int. Cl.
*H02K 7/06* (2006.01)

(52) U.S. Cl. ..... 310/84; 310/75 A; 310/75 D; 415/124.2

(58) Field of Classification Search ..... 310/49 R, 310/84, 90, 51, 75 D, 80, 82, 75 A; 415/124.2, 415/123
See application file for complete search history.

(56) References Cited

U.S. PATENT DOCUMENTS 3,255,957 A * 6/1966 Laing ..... 415/53.1
4,634,343 A * 1/1987 Nakamats ..... 416/3
4,855,629 A * 8/1989 Sato ..... 310/49 R
5,861,703 A 1/1999 Losinski

FOREIGN PATENT DOCUMENTS

| | | |
|---|---|---|
| JP | 2-100631 | 8/1990 |
| JP | 3-154613 | 7/1991 |
| JP | 5-153892 | 6/1993 |
| JP | 8-255859 | 10/1996 |
| JP | 10-5622 | 1/1998 |
| JP | 10-136634 | 5/1998 |
| JP | 11-197438 | 7/1999 |
| JP | 2000-513070 | 10/2000 |

* cited by examiner

*Primary Examiner*—Dang Le
(74) *Attorney, Agent, or Firm*—McGinn IP Law Group, PLLC

(57) ABSTRACT

A fan motor includes: a stepping motor for rotating a rotating shaft; an impeller rotated by the rotating shaft; and a connecting member for rotatably connecting the impeller relative to the rotating shaft. The connecting member absorbs an inertia force of the impeller while idly rotating the rotating shaft relative to the impeller in starting the motor and rotating the impeller to follow the rotating shaft as a revolution number of the rotating shaft increases.

14 Claims, 6 Drawing Sheets

NON- EXCITED STABILIZED POSITION (ENERGIZATION OFF)

ENERGIZATION ON

ENERGIZATION OFF

ENERGIZATION ON

ENERGIZATION OFF (COMPLETE OF ONE ROTATION)

FAN MOTOR

BACKGROUND OF THE INVENTION

The present invention relates to a fan motor used in a dehumidifier, an insecticidal apparatus or the like for realizing low current, low noise and long life.

In a related art, an electric fan used in a dehumidifier or the like is proposed (refer to, for example, Patent References 1 through 3, 8). The related arts do not take driving an electric motor by a battery into consideration and are not to realize low current, low noise and long life.

In contrast thereto, there have been proposed a technology (refer to, for example, Patent Reference 4) with regard to a control for restraining current consumption by detecting an effect by a fan motor and controlling (reducing) a revolution number of the fan motor, or intermittently driving the fan motor in accordance with an amount of the effect to achieve low power consumption of the fan motor, a technology (refer to, for example, Patent reference 5) constituted by a single blade using a piezoelectric element and the like.

However, when constituted by the single blade, a booster circuit is required and therefore, the fan motor becomes expensive.

Further, there is known a single phase stepping motor for a timepiece as a low current consumption type motor (refer to, for example, Patent References 6, 9), however, a torque thereof is very small and therefore, such a motor is difficult to be applied to a fan motor.

Although there is proposed a fan motor constituting a drive source by a stepping motor in Patent Reference 7, the motor cannot be started and becomes out of phase by driving the motor by a low current since a moment of inertia of an impeller is large and it is hard to realize low current driving.

Further, the Patent References 2, 3 disclose a constitution in which a motor shaft is provided with a fan receiving portion, and a fan is driven by a friction between the motor shaft and the fan receiving portion, however, the constitution is for stopping the fan even when the motor is rotating in the case that the apparatus is inclined, a clearance is provided in a radial direction between the motor shaft and the fan and therefore, there is a case of shifting a gravitational center of the fan of the motor shaft to thereby cause a deterioration in balance, vibration, or noise.

Patent Reference 1: JP-UM-A-2-100631
Patent Reference 2: JP-A-3-154613
Patent Reference 3: JP-A-11-197438
Patent Reference 4: JP-A-U-5622
Patent Reference 5: JP-T-2000-513070
Patent Reference 6: JP-B-61-11390
Patent Reference 7: JP-A-10-36634
Patent Reference 8: JP-A-5-153892
Patent Reference 9: JP-A-8-255859

In view of the above-described situation, in the related art, a DC motor with a blush increasing a resistance value of a rotor is used as a fan motor to provide a no load current of several mA, however, since the motor is driven continuously for a long period of time, wear of the blush is brought about and life there of poses a problem. Therefore, it is conceivable to use a blushless motor which is not provided with a contact of a blush or the like to prolong life thereof, however, in the case of the blushless motor, at least several mA of current is needed only for a hall element, several tens mA of current consumption is needed including energization of other driving circuit or the motor, and therefore it is difficult to drive the motor continuously for a long period of time by using, for example, a battery.

Further, it is conceivable to use a sensorless motor which is not provided with a hall element, however, since a reversing current of a coil is detected a starting characteristic needs to be high, as a result, low power consumption formation is difficult and the motor becomes expensive. Further, it is possible to realize a low current driving by using a stepping motor which does not need a hall element is used. However, since a starting torque is small, when an object having a large moment of inertia such as an impeller is intended to drive to rotate, the stepping motor can not be started but becomes out of phase and therefore it is difficult to drive the stepping motor by a low current.

SUMMARY OF THE INVENTION

The invention has been carried out in view of the above-described problem and it is an object thereof to provide a fan motor capable of driving to rotate an impeller with low current, low noise and long life.

In order to solve the aforesaid object, the invention is characterized by having the following arrangement.

(1) A fan motor comprising:
a stepping motor for rotating a rotating shaft;
an impeller rotated by the rotating shaft; and
a connecting member for rotatably connecting the impeller relative to the rotating shaft,
wherein the connecting member absorbs an inertia force of the impeller while idly rotating the rotating shaft relative to the impeller in starting the motor and rotating the impeller to follow the rotating shaft as a revolution number of the rotating shaft increases.

(2) The fan motor according to (1), wherein the connecting member is a coil spring having one end connected to the impeller and the other end fixed to the rotating shaft, the coil spring been wound around the rotating shaft.

(3) The fan motor according to (1), wherein the stepping motor includes a stator wound with a coil and a rotor having a magnet arranged to be opposed to the stator so that the rotor is rotated by changing a magnetic pole of the stator by energization of the coil (4) The fan motor according to (3) further comprising a driving circuit including a CMOS transistor for controlling energization of the coil.

(5) The fan motor according to (4), wherein the driving circuit is equivalent to an IC of a timepiece.

(6) The fan motor according to (4), wherein a pulse frequency of the driving circuit output in starting is set to be lower than a pulse frequency in a steady state.

(7) The fan motor according to (4) further comprising a solar cell provided at a portion of an exterior of the fan motor, wherein the driving circuit is driven by the solar cell as a power source.

As has been explained above, according to the invention, the impeller can be driven to rotate with low current, low noise and long life.

DETAILED DESCRIPTION OF PREFERRED EMBODIMENTS

A description will be given of a preferable embodiment of the invention in reference to the attached drawings as follows.

The embodiment described below is an example for carrying out the invention and the invention is applicable to the embodiment, described below, modified within a range not deviated from a gist thereof.

Figure 1:
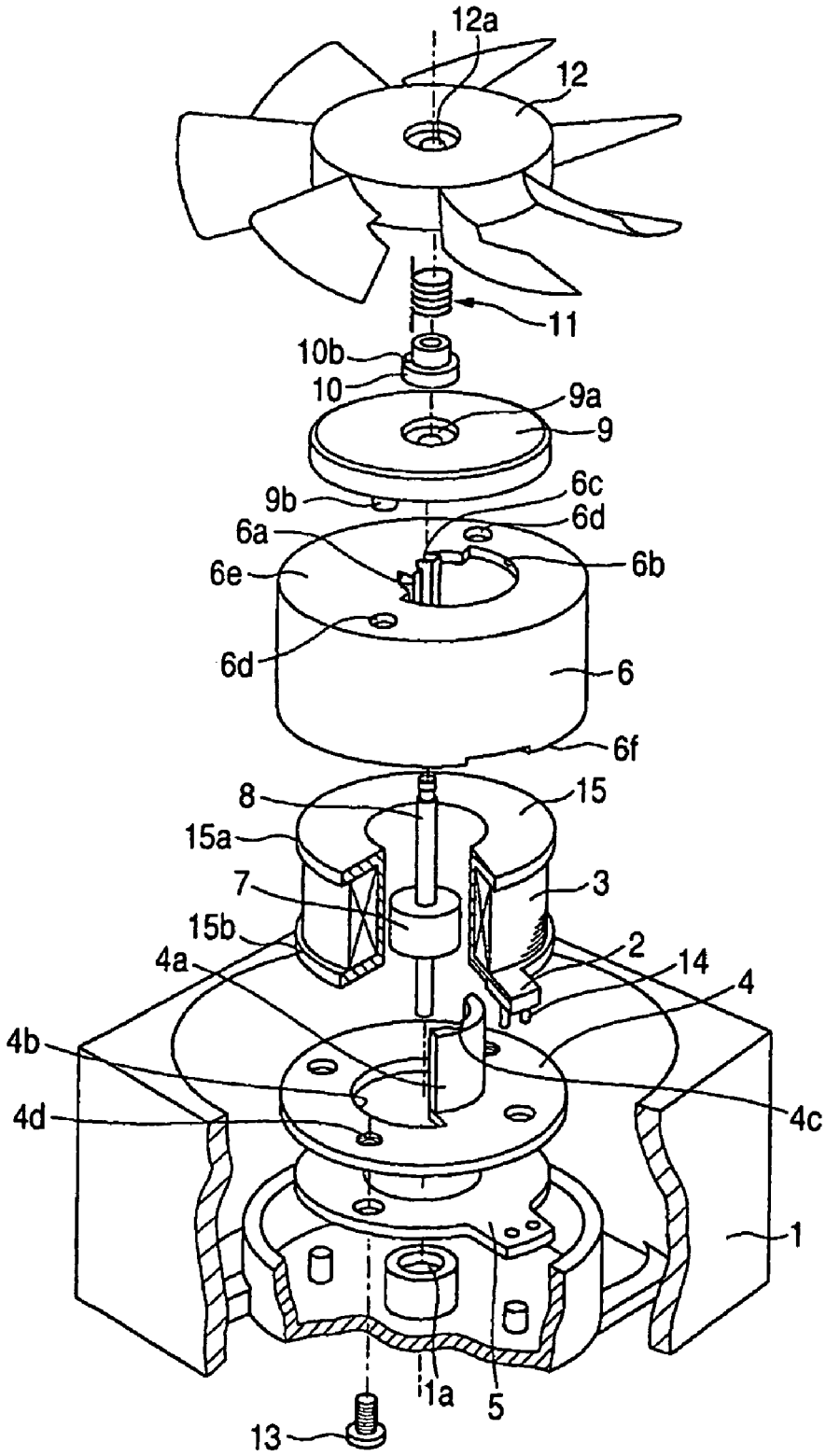
FIG. 1 is an exploded view of a fan motor of an embodiment according to the invention.

FIG. 1 is an exploded perspective view of a fan motor of the embodiment according to the invention, and FIG. 2 illustrates a side sectional view in a state of assembling the fan motor of FIG. 1 (except impeller).

As shown by FIG. 1 and FIG. 2, according to the fan motor of the embodiment, an impeller 12 having a plurality of blade portions, such as an axial fan, a silocco fan or the like is connected to an rotating shaft 8 of a single phase PM type stepping motor.

According to the single phase PM type stepping motor, a rotor is constituted by fixing a rotor magnet (permanent magnet) 7 in a cylindrical shape magnetized in a single pole (two poles divided equally to two at a diameter thereof and magnetized to provide magnetic poles (S pole and N pole) symmetrical and reverse to each other) to the rotating shaft 8. The rotating shaft 8 is supported rotatably by a pair of bearings 1*a*, 9*a* combined in an axial direction. The bearing 1*a* is a portion of a housing 1 in a box shape constituting an outer shape of the motor, and provided to project at a center portion of the housing 1 to rotatably support one end portion of the rotating shaft 8 in a thrust direction. The bearing 9*a* rotatably supports other end portion of the rotating shaft 8 in a radial direction by a hole formed at a center portion of a bearing member 9 in a circular disk shape. The bearing member 9 is fixed to an end portion 6*e* of a yoke 6 in a shape of a cylinder having a bottom (cup-like shape) by press-fitting a projected portion 9*b* to an attaching hole 6*d* serving also as a positioning function.

Meanwhile, a stator is provided with a coil 3 arranged so as to be opposed to the rotor magnet 7 concentrically therewith with a predetermined clearance relative to the rotor magnet 7, and yokes 4, 6 as magnetic members surrounding to hold the coil 3 and having magnetic pole portions 4*a*, 6*a* interposed between the rotor magnet 7 and the coil 3.

The yokes 4, 6 are provided with the first yoke 4 in a circular disk shape constituted by a thin plate, and the second yoke 6 in the shape of the cylinder having the bottom an opening end portion 6*f* of which is closed by the first yoke 4. The first yoke 4 includes an opening portion 4*b* opened concentrically with a center axis of the rotating shaft 8 of the rotor, and the first magnetic pole portion 4*a* in a shape of an arc erected by drawing from a portion of a side edge portion of the opening portion 4*b* to a side of the coil 3. Further, a bottom portion of the second yoke 6 includes an opening portion 6*b* opened concentrically with the center axis of the rotating shaft 8 of the rotor, and the first magnetic pole portion 6*a* in the arc shape erected by drawing from a portion of a side edge portion of the opening portion 6*b* to a side of the coil 3.

The first magnetic pole portion 4*a* and the second magnetic pole portion 6*a* are provided at positions symmetrical with each other relative to the rotating shaft 8 of the rotor.

As to the coil 3, a bobbin 15 made of a resin in a cylindrical shape having flanges 15*a*, 15*b* having diameters enlarged at both ends thereof is wound with a wire so that the axis of the wound wire coincides with the rotating shaft 8 of the rotor.

The flange 15*b* at one end of the bobbin 15 is provided with an electrode portion 2 extended therefrom for energization of the coil 3 for excitation to thereby generate a magnetic field of S pole or N pole at the first and the second magnetic pole portions 4*a*, 6*a*. The electrode portion 2 includes a pair of electrode pins 14 that are projected therefrom and electrically connected to respective end portions of the coil 3. The electrode pins 14 are electrically connected to a circuit board 5 attached to a rear face of the first yoke 4 by solder or the like and connected to an outside driving circuit for controlling the energization of the coil 3 via a connector or the like. The circuit board 5 is formed with a wiring pattern to generate a pulse voltage waveform to be applied to the coil 3.

The first yoke 4 and the second yoke 6 are mechanically coupled by fitting or the like in a state of containing the coil 3. Further, the first yoke 4 is fixed to the housing by screwing a screw 13 to a screw hole 4*d* with putting the circuit board 5 therebetween.

The first and the second magnetic pole portions 4*a*, 6*a* constitute magnetic poles that are excited in response to energization of the coil 3 and rotate the rotor magnet 7 by reversing polarities of the magnetic poles. Recessed grooves (or notches) 4*c*, 6*c* are provided at portions of inner peripheral portions of the first and the second magnetic pole portions 4*a*, 6*a*. The recessed grooves 4*c*, 6*c* make a clearance between the first and the second magnetic pole portions 4*a*, 6*a* and an outer peripheral portion of the rotor magnet 7 nonuniform, and form an electromagnetically stabilized position and a stabilized position when not excited (refer to "non-excited stabilized position", hereinafter) of the rotor magnet 7 to enable to rotate the rotor magnet 7 by self starting (refer to FIG. 6).

That is, at non-excited stabilized position, such a positional relationship is established in which a direction D1 (refer to FIG. 6) of a magnetic flux generated between the first and the second magnetic pole portions 4*a*, 6*a* in the excitation and a polarity direction D2 of the rotor magnet 7 are intersected to shift (not in parallel with each other) (refer to FIG. 6A, FIG. 6C and FIG. 6D) due to a cogging torque applied to the magnetic poles of the rotor magnet 7 from the first and the second magnetic pole portions 4*a*, 6*a*.

Figure 6A:
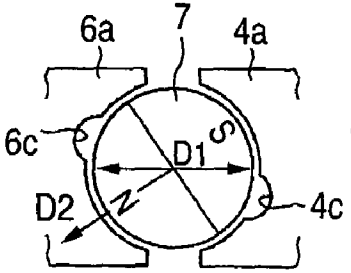
FIGS. 6A to 6E illustrate views for explaining operation of rotating the fan motor according to the embodiment.
Figure 6B:
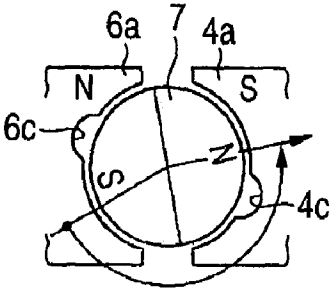
Figure 6C:
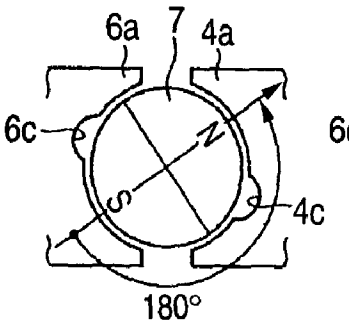
Figure 6D:
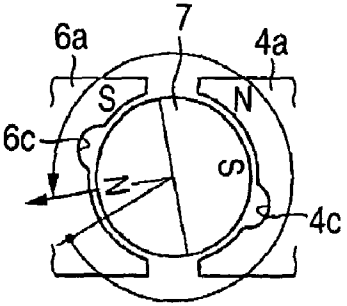

At the electromagnetically stabilized position, the magnetic poles of the rotor magnet 7 are exerted with an attraction force and a repulsion force from the first and the second magnetic pole portions 4*a*, 6*a* to balance, and such a positional relationship is established in which the polarities of the rotor magnet 7 are reversed from the nonexcited stabilized position by less than 180° (refer to FIG. 6B and FIG. 6D).

Figure 2A:
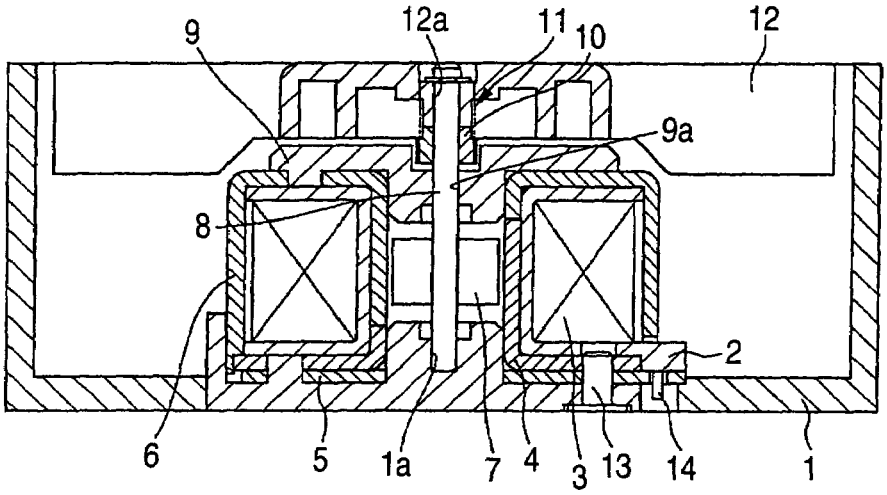
FIG. 2A illustrates a side sectional view of a state of assembling the fan motor of FIG. 1 (except impeller) and FIG. 2B illustrates an exploded perspective view of a coupling member and related portions.
Figure 2B:
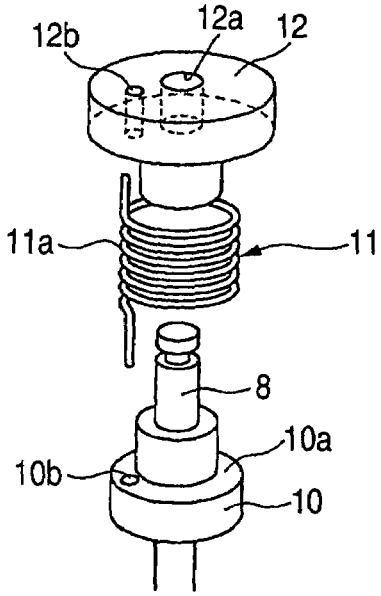

As shown in FIGS. 2A and 2B, the rotating shaft 8 is slidably (idly) inserted into a shaft hole 12*a* provided at a center axis of rotating the impeller 12 and is connected to the rotating shaft 8 relatively rotatably by a connecting member.

The connecting member is a coil spring 11 one end of which is connected to an attaching hole 12*b* provided at a vicinity of the shaft hole 12*a* of the impeller 12, other end of which is fixed to an attaching hole 10*b* of a holder 10 attached to the rotating shaft 8 by press-fitting or the like and which is wound around the rotating shaft 8. A coil portion 11*a* of the coil spring 11 is held between the impeller 12 and a stepped difference portion 10*a* of the holder 10.

As to the coil spring 11, a torsional torque thereof is set weak by reducing a wire diameter thereof in order to reduce a spring constant. When starting the motor, a moment of inertia in starting operated to the rotating shaft 8 is reduced by absorbing an inertia force (moment) of the impeller 12 while idly rotating the rotating shaft 8 relative to the impeller 12 and thereafter, the force absorbed by the coil spring 11 is discharged as a revolution number of the rotating shaft 8 is increasing to rotate the impeller 12 to follow the rotating shaft 8.

As to the connecting member, even when a moment of inertia of the impeller is large as in the constitution of the related art in which the impeller is fixed to the rotating shaft and there is provided a large moment of inertia by which the motor is difficult to start, or in starting the motor, the motor becomes out of phase, an object having a large moment of inertia such as impeller can be driven to rotate by using the stepping motor having the small starting torque and therefore, out of phase in starting does not occur and the motor can be driven with low current, low noise and long life.

Figure 3:
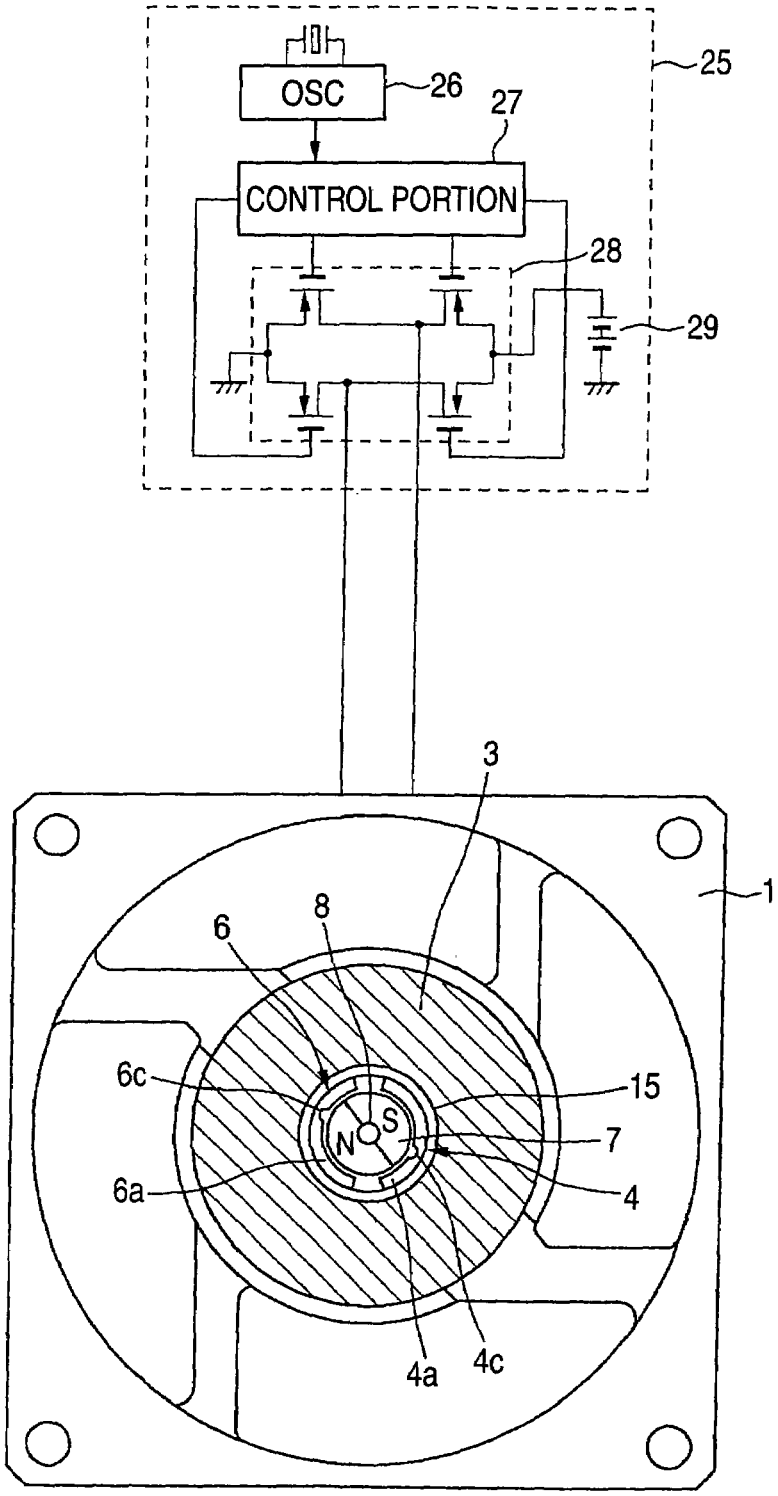
FIG. 3 is a block diagram showing a driving circuit of the embodiment according to the invention.
Figure 4:
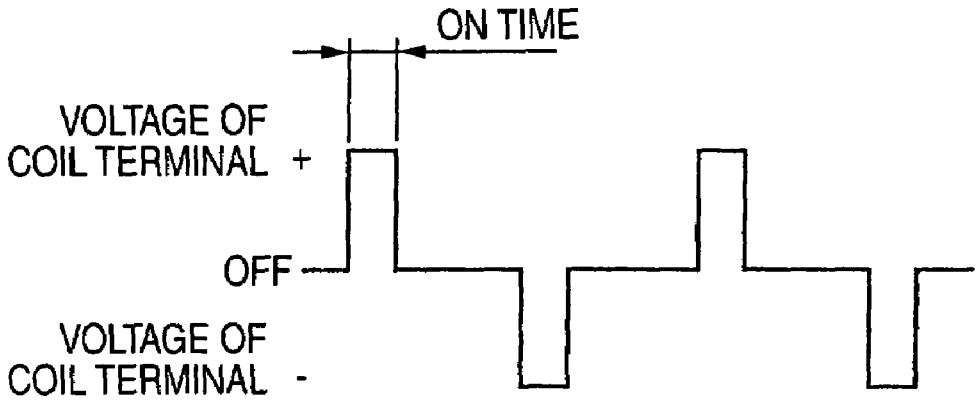
FIG. 4 is a diagram showing a voltage waveform of driving the fan motor generated by the driving circuit of FIG. 3.

FIG. 3 is a block diagram showing a driving circuit of the embodiment according to the invention, and FIG. 4 is a diagram showing a voltage waveform of driving the fan motor generated by the driving circuit of FIG. 3.

As shown in FIG. 3, a driving circuit 25 includes 2 pieces of dry cells 29 as a power source, an oscillating circuit 26 for outputting a clock signal, a control portion 27 for dividing and shaping a waveform of the output clock signal to output a drive control signal to respective gates of CMOSFET 28 comprising 4 CMOS transistors, thereby a drive voltage having an alternating pulse waveform periodically reversed as shown in FIG. 4 to between terminals of the coil 7 so that the signal phase stepping motor is driven in constant rotation. Further, according the embodiment, ON time of the drive voltage is, for example, 20 ms and the motor revolution number is 480 rpm.

Figure 5:
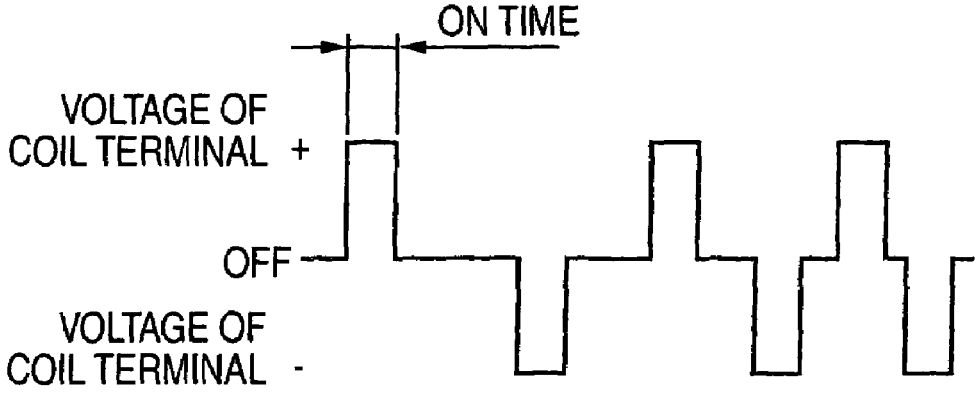
FIG. 5 is a diagram showing a voltage waveform of driving the fan motor generated by the driving circuit of FIG. 3.

FIG. 4 shows an example of setting a pulse frequency constant from starting. However, as shown in FIG. 5, by setting the pulse frequency in starting to be lower than that in a steady state (slow up voltage waveform), a slow up function for gradually increasing the revolution number of the stepping motor from starting to steady state can be added and the operation of the connecting member for driving to rotate the impeller having the large moment of inertia by low current can further be promoted.

The coil resistance of the single phase stepping motor according to the embodiment is several hundreds ohm which is considerably larger than that of a general stepping motor, further, there is also a case in which a resistor having several hundreds ohm is connected in series and therefore a drive current becomes several mA.

Since an IC for a general purpose time piece can be used as the driving circuit 25, cost is inexpensive, current consumption is small, and driving for a long period of time can be carried out by using a dry cell similar to a time piece or the like (for example, continuous driving of 40 days can be realized since the voltage is 3 V by 2 pieces of batteries, the current consumption is 2 mA, and the dry cell is provided with a capacity of 2000 mA)

FIGS. 6A to 6E illustrate views for explaining operation of rotating the fan motor according to the embodiment and showing a positional relationship between the first and the second magnetic pole portions 4*a*, 6*a* and the rotor magnet 7.

At the nonexcited stabilized position (energization OFF) of FIG. 6A, such a positional relationship is established in which the direction D1 of the magnetic flux generated between the first and the second magnetic pole portions 4*a*, 6*a* and the polarity direction D2 of the rotor magnet 3 are intersected to shift from each other since a very small cogging torque is applied to the magnetic poles of the rotor magnet 7 from the first and the second magnetic pole portions 4*a*, 6*a*. Although it is preferable to make the cogging torque as small as possible to weaken the magnetic field, the cogging torque is not nullified.

By exciting the first and the second magnetic pole portions 4*a*, 6*a* by energization (ON) of the coil 3 from the above-described nonexcited stabilized position, the first and the second magnetic pole portions 4*a*, 6*a* and the magnetic poles of the rotor magnet 7 having different polarities are attracted and the magnetic poles having the same polarity are repulsed to balance, and the rotor magnet 7 is rotated from the non-excited stabilized position of FIG. 6A to an electromagnetically stabilized position of FIG. 6B at which the polarities of the rotor magnet 7 are rotated in the clockwise direction by less than 180 degrees.

Thereafter, when energization of the coil 3 is stopped (OFF) by operation of the above-described cogging force, the rotor magnet 3 is slightly rotated further from the electromagnetically stabilized position of FIG. 6B to rotate to the non-excited stabilized position of FIG. 6C rotated from the position of FIG. 6A by 180 degrees.

Next, by generating polarities reverse to those in exciting the first and the second magnetic pole portions 4*a*, 6*a* by outputting a pulse reverse to that in energization of the coil 3 as shown by FIG. 6B from the non-excited stabilized position of FIG. 6C, the magnetic poles of the rotor magnet 7 having polarities different from those of the first and the second magnetic pole portions 4*a*, 6*a* are attracted and the magnetic poles having the same polarities are repulsed to each other to balance and the rotor magnet 7 is rotated to an electromagnetically stabilized position of FIG. 6D at which the polarities of the rotor magnet 7 are rotated in clockwise direction from the non-excited stabilized position of FIG. 6C by less than 180 degrees.

Figure 6E:
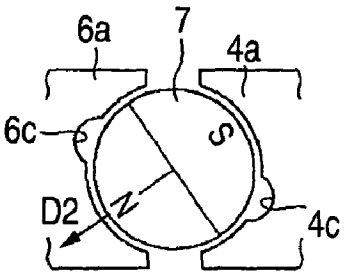

Thereafter, when energization of the coil 3 is stopped (OFF), by the operation of the above-described cogging force, the rotor magnet 7 returns to the position of FIG. 6A to finish one rotation by being rotated slightly further from the electromagnetically stabilized position of FIG. 6D to a non-excited stabilized position of FIG. 6E (position rotated from the position of FIG. 6C by 180 degrees or position rotated from the position of FIG. 6A by 360 degrees).

Figure 7:
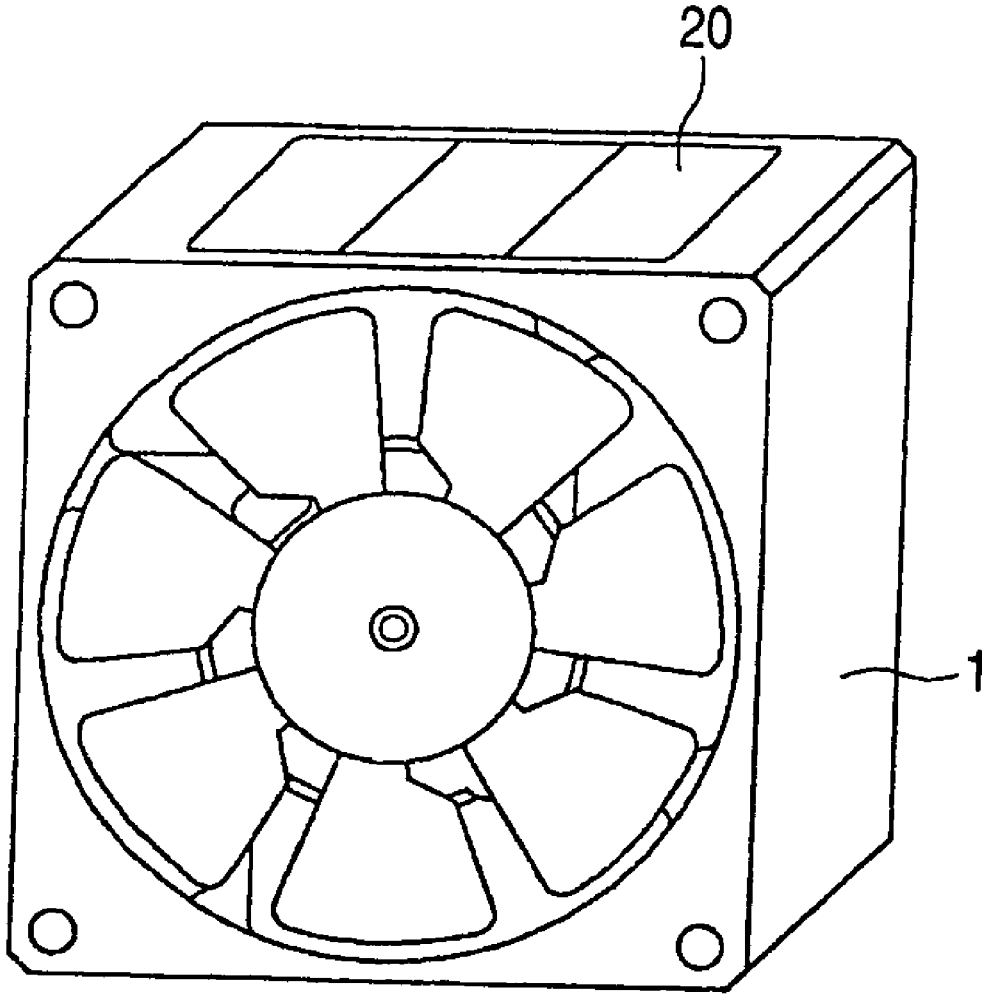
FIG. 7 is a perspective view showing an example of mounting a solar cell at an exterior of a housing of a fan motor as a modified example of the embodiment.

FIG. 7 is a perspective view showing an example of mounting a solar cell at an exterior of a housing of a fan motor as a modified example of the embodiment, a solar cell 20 is provided at a portion of a side face of the housing 1, and the driving circuit 25 is driven by using the solar cell 20 as a power source (may be used along with the dry cell 29). The fan motor according to the embodiment is driven by low current and therefore, the dry cell is dispensed with in using in daylight by the mounting solar cell having a size of, for example, about 50×20 mm.

The invention is applicable to an air cleaner, an aromatic agent sprayer, a dehumidifier, an insecticidal apparatus or the like mounted with an electric fan or the like for circulating air, for example.

Further, although according to the embodiment, an explanation has been given of an example of applying the single phase PM type stepping motor, the invention is not limited thereto but applicable to a PM type stepping motor of 2 or more phases, a stepping motor of a VR type (Variable Reluctance Type) constituting a rotor by an iron core in a gear-like shape or an HB type (Hybrid Type) constituting a rotor by an iron core in a gear-like shape and a magnet other than the PM type.

What is claimed is:

1. A fan motor comprising:

a stepping motor for rotating a rotating shaft;

an impeller rotated by the rotating shaft, the impeller including an attaching hole;

a holder that includes an attaching hole and is fixed to the rotating shaft; and a connecting member for rotatably connecting the impeller relative to the rotating shaft, wherein the connecting member comprises a coil spring having one end inserted into the attaching hole of the impeller and the other end inserted into the attaching hole of the holder, and wherein the connecting member absorbs an inertia force of the impeller while idly rotating the rotating shaft relative to the impeller in starting the motor and rotating the impeller to follow the rotating shaft as a revolution number of the rotating shaft increases.

2. The fan motor according to claim 1, wherein the stepping motor includes a stator wound with a coil and a rotor having a magnet arranged to be opposed to the stator such that the rotor is rotated by changing a magnetic pole of the stator by energization of the coil.

3. The fan motor according to claim 2, further comprising a driving circuit including a CMOS transistor for controlling energization of the coil.

4. The fan motor according to claim 3, wherein the driving circuit is equivalent to an IC of a timepiece.

5. The fan motor according to claim 3, wherein the driving circuit includes a control portion in which a pulse frequency of the driving circuit output in starting is set to be lower than a pulse frequency after starting.

6. The fan motor according to claim 3, further comprising a solar cell provided at a portion of an exterior of the fan motor, wherein the driving circuit is driven by the solar cell as a power source.

7. The fan motor according to claim 3, wherein the driving circuit is provided with a control portion for gradually shortening off time of the energization of the coil after starting.

8. The fan motor according to claim 2, wherein the stator comprises first and second yokes as magnetic members surrounding to hold the coil.

9. The fan motor according to claim 8, wherein the first and second yokes comprise first and second magnetic pole portions, respectively.

10. The fan motor according to claim 9, wherein the first and second yokes further comprise recessed grooves on an inner peripheral portion thereof to form a non-uniform clearance between the first and second pole portions and an outer peripheral portion of the magnet.

11. The fan motor according to claim 1, wherein the holder comprises a first stepped portion and the connecting member is disposed on the first stepped portion.

12. The fan motor according to claim 1, wherein the impeller comprises a second stepped portion and the connecting member is disposed on the second stepped portion.

13. The fan motor according to claim 1, wherein a portion of the impeller protrudes into a space within a coil spring.

14. The fan motor according to claim 1, wherein a portion of the holder protrudes into a space within a coil spring.

* * * * *